US010858888B2

(12) United States Patent
Lin et al.

(10) Patent No.: US 10,858,888 B2
(45) Date of Patent: Dec. 8, 2020

(54) SWIMMING POOL LADDER WITH SAFETY GATE

(71) Applicant: Intex Marketing Ltd., Tortola (VG)

(72) Inventors: Hua Hsiang Lin, Fujian (CN); Yaw Yuan Hsu, Fujian (CN)

(73) Assignee: Intex Marketing Ltd., Tortola (VG)

( * ) Notice: Subject to any disclaimer, the term of this patent is extended or adjusted under 35 U.S.C. 154(b) by 0 days.

(21) Appl. No.: 16/252,335

(22) Filed: Jan. 18, 2019

(65) Prior Publication Data

US 2019/0153780 A1 May 23, 2019

Related U.S. Application Data

(63) Continuation of application No. 15/362,619, filed on Nov. 28, 2016, now Pat. No. 10,214,962.

(30) Foreign Application Priority Data

Nov. 27, 2015 (CN) ..... 2015 1 0839694
Mar. 31, 2016 (CN) ..... 2016 3 0102616
May 16, 2016 (CN) ..... 2016 2 0431610 U

(51) Int. Cl.
*E06C 7/00* (2006.01)
*E04H 4/14* (2006.01)
*E06C 1/28* (2006.01)

(52) U.S. Cl.
CPC ..... *E06C 7/006* (2013.01); *E04H 4/144* (2013.01); *E06C 1/28* (2013.01)

(58) Field of Classification Search
CPC ... E06C 7/00; E06C 7/006; E05C 1/08; E05C 1/16; E05C 1/163; E04H 4/14;
(Continued)

(56) References Cited

U.S. PATENT DOCUMENTS 3,106,986 A 10/1963 Ray
3,225,863 A * 12/1965 Ludlow ..... E06C 7/006 182/104
(Continued)

FOREIGN PATENT DOCUMENTS

| | | |
|---|---|---|
| CN | 201190435 | 2/2009 |
| CN | 206279812 | 6/2017 |
| DE | 20208897 | 10/2002 |

OTHER PUBLICATIONS

Photograph of ladder from Kayak Pool Corporation, Photo Gallery, 1 page, available at http://www.kayakpools.com/corporate/KP_Hamburg_2.JPG,accessed on Nov. 5, 2010.
(Continued)

*Primary Examiner* — Katherine W Mitchell
*Assistant Examiner* — Shiref M Mekhaeil
(74) *Attorney, Agent, or Firm* — Faegre Drinker Biddle & Reath LLP

(57) ABSTRACT

The present disclosure provides a pool ladder with an active protection mechanism. The ladder provides a switch positioned at a significant height from the ground such that children cannot easily reach the switch. When actuated, the switch unlocks a protective door for the ladder and the ladder can be moved to access the steps. As such, the ladder can effectively prevent children from unlocking the protective door and accessing the pool.

19 Claims, 8 Drawing Sheets

(58) Field of Classification Search
CPC ..... E04H 4/144; E06B 2009/2423; E06B 2009/2441; E06B 9/02
See application file for complete search history.

(56) References Cited

U.S. PATENT DOCUMENTS

| | | | | |
|---|---|---|---|---|
| 3,288,248 | A | 11/1966 | Gurian et al. | |
| 3,311,195 | A | 3/1967 | Singer | |
| 3,372,772 | A | 3/1968 | Singer | |
| 3,428,146 | A | 2/1969 | Bair | |
| 3,447,633 | A | 6/1969 | Montalto | |
| 3,586,124 | A | 6/1971 | Kunzweller et al. | |
| 3,908,795 | A * | 9/1975 | Gannon | E04H 4/144 182/118 |
| 3,964,572 | A | 6/1976 | Gannon | |
| 3,991,851 | A | 11/1976 | Gannon | |
| 4,579,197 | A | 4/1986 | Spurling | |
| 4,805,736 | A | 2/1989 | Byrnes, Jr. | |
| 4,811,767 | A | 3/1989 | Kessler | |
| 5,080,192 | A * | 1/1992 | Kerr | E06C 1/397 182/106 |
| 5,231,809 | A * | 8/1993 | Benjamino | B60P 3/32 135/117 |
| 5,343,977 | A | 9/1994 | Bryan | |
| 5,362,116 | A | 11/1994 | Doyle et al. | |
| 5,441,126 | A | 8/1995 | Orrick | |
| 5,664,769 | A | 9/1997 | Sadinsky | |
| 5,682,960 | A | 11/1997 | Mobley et al. | |
| 5,718,089 | A * | 2/1998 | Dakin | A63H 33/008 446/110 |
| 6,666,435 | B2 | 12/2003 | Blosfelds | |
| 6,755,281 | B2 | 6/2004 | Saputo et al. | |
| 6,880,674 | B1 * | 4/2005 | St-Hilaire | E04H 4/144 182/106 |
| 7,044,511 | B2 | 5/2006 | Kliefoth et al. | |
| D525,369 | S | 7/2006 | Houze | |
| 7,100,405 | B2 * | 9/2006 | West | E05B 19/04 292/13 |
| 7,390,035 | B2 | 6/2008 | Clark et al. | |
| 7,717,231 | B2 | 5/2010 | Horton | |
| 8,127,891 | B1 * | 3/2012 | Gudinas, Jr. | A61H 35/006 182/129 |
| 8,191,681 | B2 | 6/2012 | Lipniarski | |
| 8,191,682 | B2 | 6/2012 | Lipniarski | |
| 8,202,018 | B2 | 6/2012 | Lipniarski | |
| 8,347,555 | B2 | 1/2013 | Chen | |
| 8,376,421 | B2 * | 2/2013 | Simmonds | E05B 15/101 292/251.5 |
| 8,505,989 | B2 | 8/2013 | Wells | |
| D700,715 | S | 3/2014 | Kubik | |
| 8,720,644 | B2 | 5/2014 | Naranjo et al. | |
| 8,997,929 | B1 * | 4/2015 | Todd | E06C 7/182 182/115 |
| 9,033,377 | B2 | 5/2015 | Day et al. | |
| 9,074,384 | B2 | 7/2015 | Lin et al. | |
| 9,663,989 | B2 * | 5/2017 | Moss | E06C 1/393 |
| 10,214,962 | B2 | 2/2019 | Lin et al. | |
| 2003/0079941 | A1 * | 5/2003 | Pettit | E04H 4/144 182/115 |
| 2005/0210938 | A1 | 9/2005 | Doyle et al. | |
| 2007/0193833 | A1 | 8/2007 | Nickelson | |
| 2007/0194578 | A1 | 8/2007 | Boosey et al. | |
| 2010/0090517 | A1 * | 4/2010 | Kramer | B60R 3/02 299/36.1 |
| 2011/0072574 | A1 * | 3/2011 | Hsiang Lin | E04H 4/144 4/504 |
| 2011/0073410 | A1 * | 3/2011 | Hsiang Lin | E04H 4/144 182/118 |
| 2011/0148126 | A1 * | 6/2011 | Macernis | E05B 65/0007 292/251.5 |
| 2012/0228058 | A1 | 9/2012 | Dubois | |
| 2012/0312635 | A1 | 12/2012 | Randolph | |
| 2013/0117923 | A1 | 5/2013 | Toner | |
| 2014/0225383 | A1 * | 8/2014 | Simmonds | E05C 1/08 292/238 |
| 2015/0015002 | A1 * | 1/2015 | Macernis | E05B 63/244 292/251.5 |
| 2015/0337575 | A1 * | 11/2015 | Macernis | E05B 47/004 292/138 |
| 2016/0160561 | A1 * | 6/2016 | Yu | E06C 7/02 182/127 |
| 2016/0160562 | A1 * | 6/2016 | Cheng | E06C 7/006 4/504 |
| 2017/0101821 | A1 * | 4/2017 | Shattuck | E06C 7/006 |
| 2017/0260811 | A1 * | 9/2017 | Trudeau | E06C 1/26 |

OTHER PUBLICATIONS

Confer Plastics, Inc., The Leader in Ladders Brochure, 6 pages, published Jan. 2013, available at http://www.conferplastics.com/ConferBrochureLadder.pdf.
English Abstract of Chinese Patent No. CN201190435 (Y).

* cited by examiner

SWIMMING POOL LADDER WITH SAFETY GATE

CROSS REFERENCE TO RELATED APPLICATIONS

This application is a continuation application of U.S. patent application Ser. No. 15/362,619, filed Nov. 28, 2016, which claims priority to the following Chinese patent applications, the disclosures of which are hereby expressly incorporated by reference herein in their entireties:

| Application No. | Filing Date |
|---|---|
| CN 201510839694.2 | Nov. 27, 2015 |
| CN 201630102616.X | Mar. 31, 2016 |
| CN 201620431610.1 | May 16, 2016 |

FIELD OF THE DISCLOSURE

The present disclosure relates to a ladder for a water enclosure (e.g., a swimming pool), more particularly a ladder with an active protection mechanism.

BACKGROUND OF THE DISCLOSURE

Swimming is a very popular sport and fitness exercise. With the continuous improvement of people's living quality and enhanced fitness awareness, swimming has become a more common activity. As such, above ground swimming pools are more prevalent, and a pool ladder is necessary to facilitate entry into and exit from such swimming pools.

For example, after inflation of an inflatable pool, a barrier exists between the interior and exterior areas of the pool. In certain cases, the barrier is significantly tall, and a ladder is needed for entering and exiting the pool over the barrier. Most of the commercially available ladders are of herring-bone configuration—with one side of the ladder outside the pool and the other side of the ladder inside the pool.

SUMMARY

The present disclosure provides a pool ladder with an active protection mechanism. The ladder provides a switch positioned at a significant height from the ground such that children cannot easily reach the switch. When actuated, the switch unlocks a protective door for the ladder and the ladder can be moved open to access the steps. As such, the ladder can effectively prevent children from unlocking the protective door and accessing the pool.

According to an embodiment of the present disclosure, a safety ladder is provided. The safety ladder includes: a pair of uprights; at least one step spanning a gap between the pair of uprights; a protective door pivotally coupled to one of the pair of uprights and configured for movement between a ladder configuration when the protective door is opened and the at least one step is accessible and a safety configuration when the protective door is closed and the at least one step is at least partially inaccessible; a spring coupled to the protective door, the spring applying a biasing force on the protective door to bias the protective door into the safety configuration; and a damper coupled to the protective door acting to delay closure by opposing the biasing force acting on the protective door.

According to another embodiment of the present disclosure, a safety ladder apparatus includes: a water enclosure; and a safety ladder having an inside pool portion positioned within the water enclosure and an outside pool portion positioned outside the water enclosure, the outside pool portion including: a pair of uprights defining a gap therebetween; a plurality of steps spanning the gap, the plurality of steps including a bottom-most step located closest to the ground; and a protective door configured for movement relative to the plurality of steps between a ladder configuration when the protective door is opened and a safety configuration when the protective door is closed, a lower end of the protective door being elevated above the ground and located adjacent to the bottom-most step.

According to yet another embodiment of the present disclosure, a safety ladder apparatus includes: a water enclosure; a safety ladder including a pair of uprights defining a gap therebetween with at least one step spanning the gap; the safety ladder having an inside pool portion positioned within the water enclosure and an outside pool portion positioned outside the water enclosure; the outside pool portion including: a protective door coupled to the pair of uprights; a support base coupled to each upright and the protective door at a bottom surface of the protective door, the support base providing a surface about which the protective door can rotate to transition between a ladder configuration when the protective door is opened and the at least one step is accessible and a safety configuration when the protective door is closed and the protective door covers the at least one step; a spring coupled to the protective door, the spring applying a biasing force onto the protective door to bias the protective door to the safety configuration; and a damper coupled to the protective door acting to delay closure by opposing the biasing force acting on the protective door.

BRIEF DESCRIPTION OF THE DRAWINGS

The above-mentioned and other features and advantages of this disclosure, and the manner of attaining them, will become more apparent and will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1:
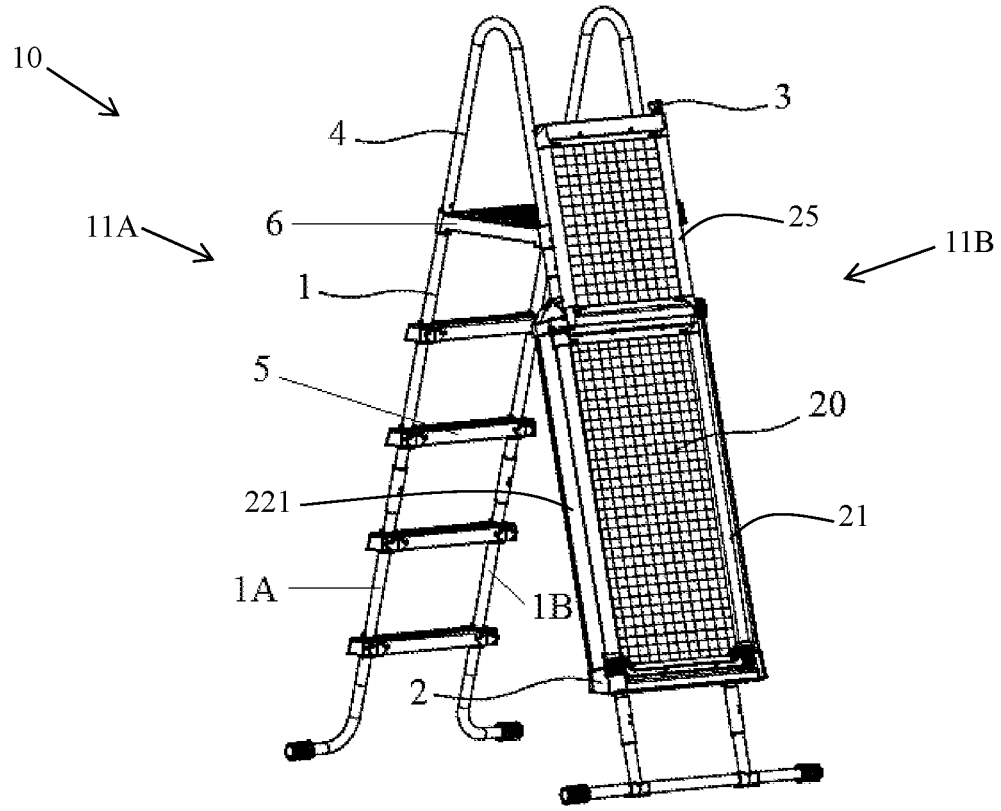
FIG. 1 is a perspective view of a pool ladder assembly in accordance with a first embodiment of the present disclosure, the pool ladder assembly illustrated in a safety configuration where a ladder door covers steps on one side of the assembly such that the steps are inaccessible to a user.
Figure 2:
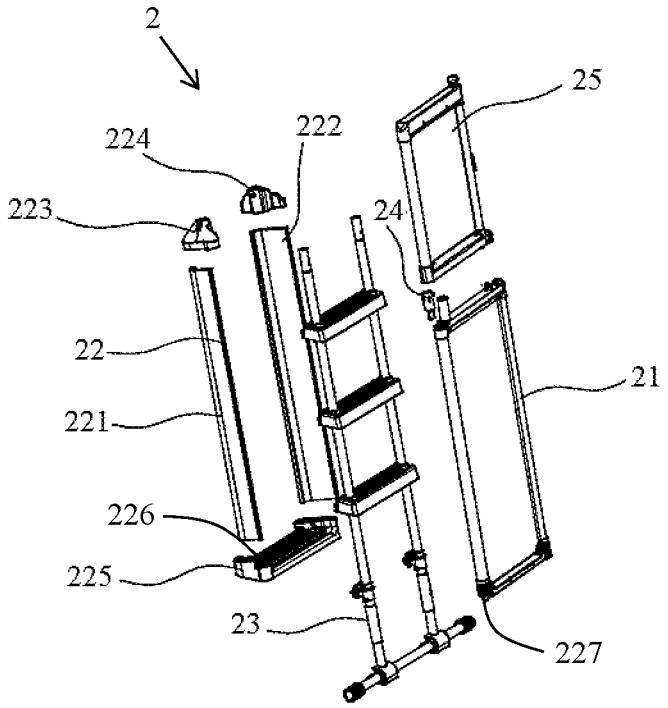
FIG. 2 is an exploded perspective view of the ladder sheet of the pool ladder assembly of FIG. 1.
Figure 2A:
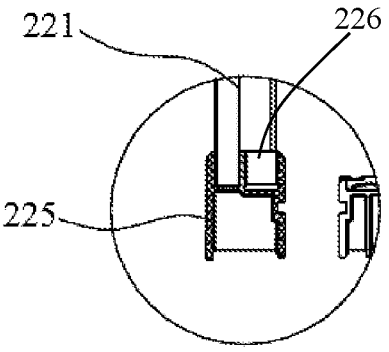
FIG. 2A is a cross sectional view of a support base of the pool ladder assembly of FIG. 1.
Figure 3:
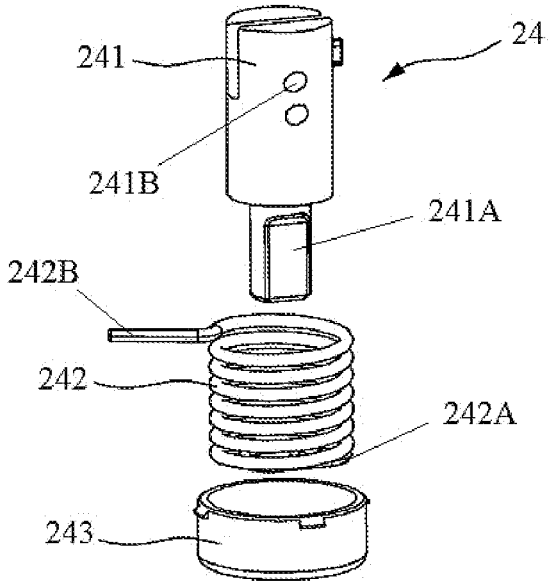
FIG. 3 is an exploded view of a door closing mechanism of the pool ladder assembly of FIG. 1.
Figure 4:
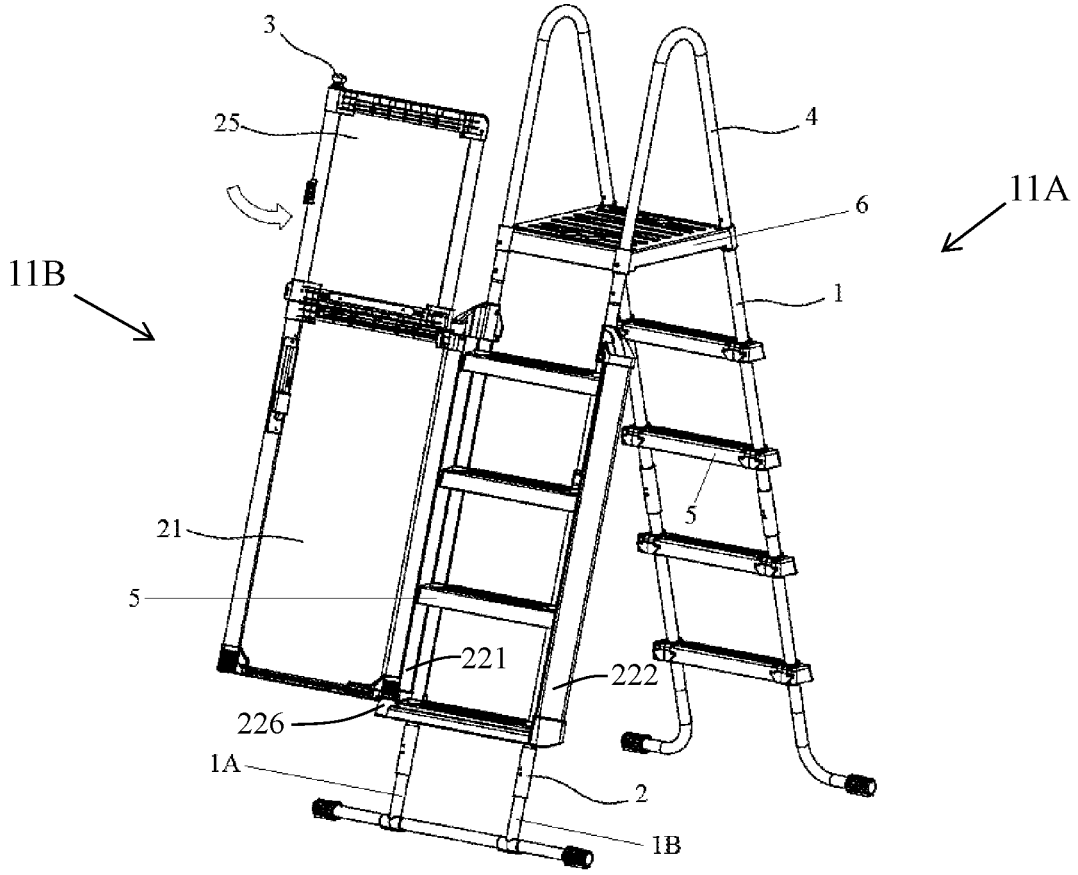
FIG. 4 is a perspective view of the pool ladder assembly of FIG. 1 illustrated in a ladder configuration where the steps of the assembly are exposed such that the steps are accessible to a user.

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrative devices and described methods and further applications of the principles of the invention which would normally occur to one skilled in the art to which the invention relates.

As shown in FIGS. 1-7A, a pool ladder 10 with a protection mechanism is shown. Pool ladder 10 is configured for use with an above ground water enclosure (e.g., swimming pool). Pool ladder 10 includes a ladder body 1 having an inside pool portion 11A configured for placement inside the water enclosure and an outside pool portion 11B configured for placement outside the water enclosure, steps 5 that traverse a gap formed between a pair of uprights 1A, 1B of ladder body 1 along both inside and outside portions 11A and 11B, a protective door assembly 2 coupled to outside pool portion 11B, a self-lock switch 3 coupled to outside pool portion 11B, and a handrail 4 positioned on the upper part of ladder body 1 between the inside and outside portions 11A, 11B. In one embodiment, handrail 4 is integrally formed with the pair of uprights 1A, 1B of ladder body 1 and passes over an outer wall of the water enclosure.

Protective door assembly 2 includes a door panel 20 surrounded by a lower door frame 21 and an upper door frame 25 such that some or all steps 5 on outside pool portion 11B of pool ladder 10 are substantially covered when pool ladder 10 is in a safety configuration as discussed below. Providing a lower door frame 21 and an upper door frame 25 that are separable from one another may facilitate compact storage of protective door assembly 2, but it is also within the scope of the present disclosure to provide a single door frame around door panel 20. Door panel 20 may have a solid or partially open (e.g., mesh) construction. The lower end of the protective door assembly 2 may be positioned at or below the height of the bottom-most step 5 and elevated above the ground. In this manner, the protective door assembly 2 may prevent use of the bottom-most step 5 and may avoid interference with the ground.

Protective door assembly 2 further includes an automatic door closing mechanism 24 that is coupled to an upper surface of the lower door frame 21. Lower door frame 21, upper door frame 25, and automatic door closing mechanism 24 are pivotally connected to one side of a stationary door module 23 along one of uprights, illustratively the left upright 1A, on the outside pool portion 11B. The hinged connection enables door assembly 2 to pivot about the upright 1A and transition between a safety configuration in which steps 5 are inaccessible to a user (e.g., a child) and a ladder configuration in which steps 5 are accessible to the user. Along the right upright 1B opposite of the hinged connection between protective door assembly 2 and the left upright 1A, there is a cassette 231 which can house a snap joint 32 of self-lock switch 3 as discussed below.

Self-lock switch 3 includes a movable bar 31 (FIG. 5) which passes through and extends along one side of the upper door frame 25, and a snap joint or lock 32, which moves along with movable bar 31 as discussed below. The top of the movable bar 31 protrudes from the upper surface of upper door frame 25. The top of moveable bar 31 may be elevated sufficiently above the ground to allow access by an adult user while preventing access by a child user. In one embodiment, the top of movable bar 31 of self-lock switch 3 is above the ground by as little as 50 inches, 52 inches, 54 inches, as great as 56 inches, 58 inches, 60 inches, or within any range defined between any two of the foregoing values. In an exemplary embodiment, the top of movable bar 31 is 54 inches above the ground.

Door closing mechanism 24 of protective door assembly 2 (FIG. 3) includes a damper 241, a torsion spring 242 configured to bias protective door assembly 2 to a closed position in the safety configuration as described below, and a base 243 all coupled to one another. The components of door closing mechanism 24 are described further below.

Torsion spring 242 may have a first working end 242A coupled to the pivotable door panel 20 and a second working end 242B coupled to the stationary door module 23. Thus, when door closing mechanism 24 is assembled onto protective door assembly 2, torsion spring 242 links door panel 20 and stationary door module 23 together. In one embodiment, the first working end 242A of torsion spring 242 is coupled to the pivotable door panel 20 via base 243 that travels with lower door frame 21 of the pivotable door panel 20, and second working end 242B of torsion spring 242 is coupled to the stationary door module 23 via a top cover 223 of a door frame set 22, which is described further below. Torsion spring 242 stores energy when door panel 20 is open in the ladder configuration and releases energy as door panel 20 closes to the safety configuration.

Similar to torsion spring 242, damper 241 may have a first portion 241A coupled to the pivotable door panel 20 and a second portion 241B coupled to the stationary door module 23. In one embodiment, the first portion 241A of damper 241 is keyed into the lower door frame 21 of the pivotable door panel 20, and second portion 241B of damper 241 is coupled to the stationary door module 23 via a top cover 223 of a door frame set 22, which is described further below. Between the first and second portions 241A, 241B, damper 241 may include a pressure chamber (not shown) that resists rotation, thereby slowing rotation of door panel 20 relative to door module 23. In certain embodiments, damper 241 may slow the closure of door panel 20 to about 15 seconds, 20 seconds, 25 seconds, or more.

When installed onto the outside pool portion 11B of ladder body 1, pivotable door panel 20 is coupled to ladder body 1 and a door frame set 22. The illustrative door frame set 22 is coupled to stationary door module 23 such that door frame set 22 is supported entirely by ladder body 1, not the ground. Thus, ladder body 1 and protective door assembly 2 have a compact profile. Door frame set 22 includes a left pillar 221 positioned adjacent to left upright 1A, a right pillar 222 positioned adjacent to right upright 1B, a top cover 223 of the left pillar 221, a top cover 224 of the right pillar 222, and a support base 225. A lower end of both the left pillar 221 and the right pillar 222 are each inserted into the support base 225 of door frame set 22 and fastened as shown in at least FIG. 2. Support base 225 may extend between the left and right uprights 1A, 1B to serve as a step 5, illustratively the bottom-most step 5. Support base 225 may provide support for the lower end of door panel 20 and also provides a pivot seat 226 upon which a pivot pin 227 of the lower door frame 21 of the door panel 20 can pivot when transitioning between a ladder configuration and a safety configuration. In this manner, the lower end of door panel 20 may be located on or near the bottom-most step 5 and elevated above the ground. As shown in FIGS. 1-4, the pivot seat 226 is located forward of the left upright 1A, such that the lower door frame 21 is located forward of the left upright 1A. The left pillar 221 extends horizontally across the support base 225 between the left upright 1A and the lower door frame 21 and vertically along the height of the lower door frame 21 to conceal the space therebetween. Similarly, the right pillar 222 extends horizontally across the support base 225 between the right upright 1B and the lower door frame 21 and vertically along the height of the lower door frame 21 to conceal the space therebetween. The upper ends of the left pillar 221 and the right pillar 222 are coupled to the top covers 223, 224, respectively. In an exemplary embodiment, door frame set 22 can be made by folding, machining, or extruding suitable materials, such as iron, plastic, aluminum, steel, or wood, for example. However, it is contemplated that in alternate embodiments, other suitable materials may be used.

Figure 5:
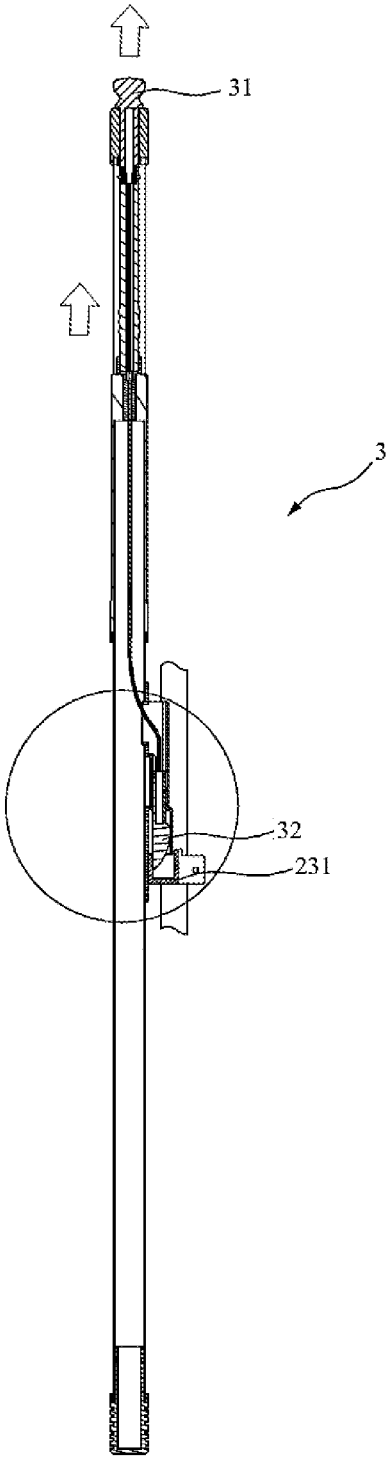
FIG. 5 is a cross sectional view of a self-lock switch of the ladder assembly of FIG. 1 illustrating the operation of the self-lock switch to transition the ladder assembly to the ladder configuration.
Figure 5A:
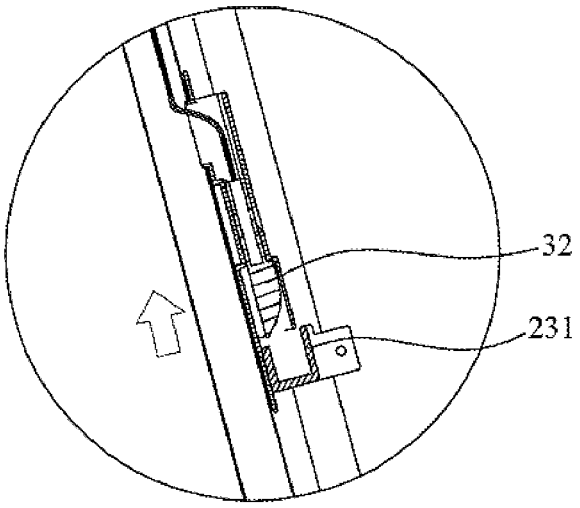
FIG. 5A is a detailed view of the self-lock switch of FIG. 5.

As shown in FIG. 5, to access steps 5 of ladder body 1, bar 31 is actuated or pulled away from the upper surface of upper door frame 25. The upward movement of bar 31 is transferred to snap joint 32, which disengages from cassette 231 and unlocks protective door 2. Pool ladder 10 can then be moved into the ladder configuration where users can access steps 5 of outside pool portion 11B and enter a water enclosure (e.g., swimming pool). While protective door assembly 2 is open in the ladder configuration, torsion spring 242 remains under tension storing potential energy to be later applied when closing protective door 2 as discussed below.

Figure 6:
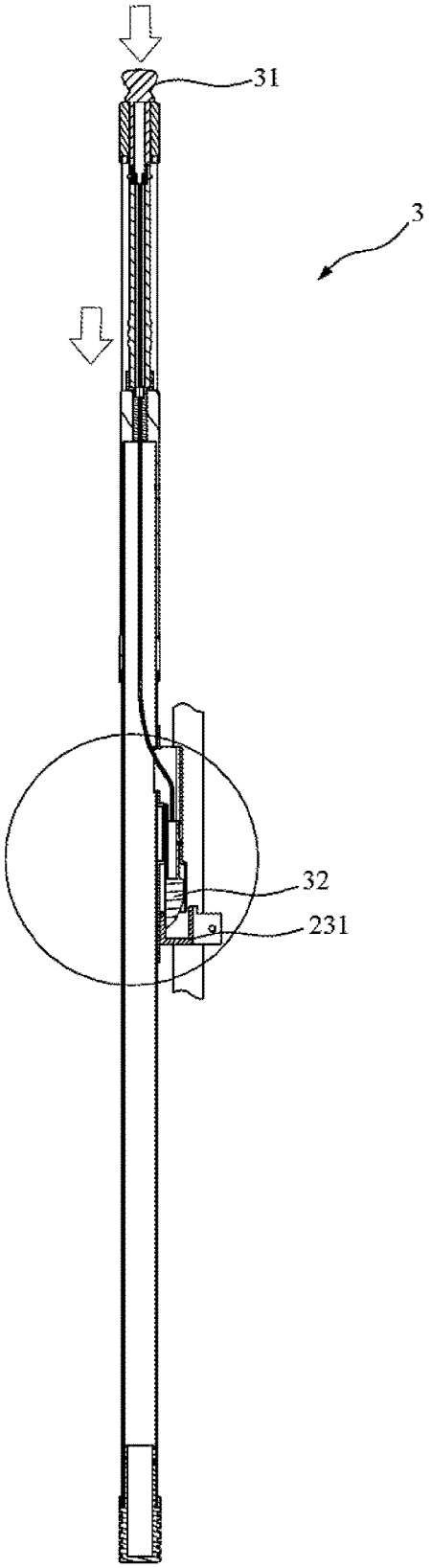
FIG. 6 is a cross sectional view of the self-lock switch of FIG. 5 illustrating the operation of the self-lock switch to transition the ladder assembly to the safety configuration.

Once bar 31 is released as shown in FIG. 6, bar 31 begins its descent to return to its original position under the force of gravity. The downward movement of bar 31 may also be encouraged using a spring. Once protective door assembly 2 is released, torsion spring 242 releases its potential energy and applies a biasing force onto protective door assembly 2 to move protective door assembly 2 into a closed position or safety configuration in which steps 5 of outside pool portion 11B are inaccessible to the user. As spring 242 moves door panel 20 into its closed position, damper 241 absorbs a portion of the biasing force to reduce the biasing force applied onto door panel 20. In this way, damper 241 acts to slow the speed at which door panel 20 moves into its closed position, which allows users to access steps 5 for a period of time as pool ladder 10 gradually returns to its safety configuration.

Figure 6A:
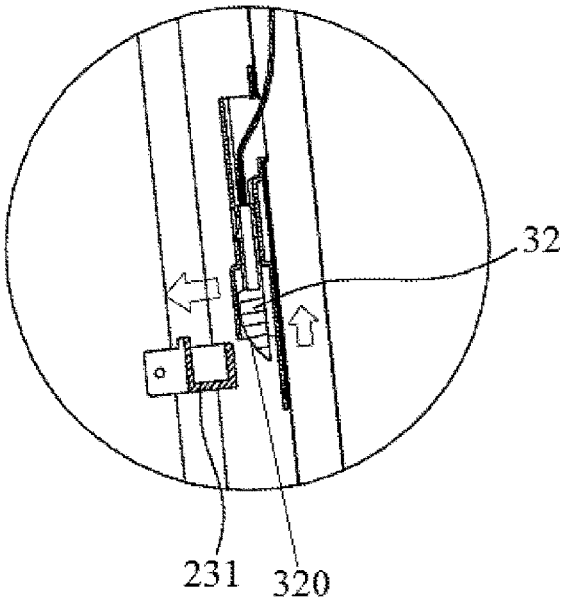
FIG. 6A is a detailed view of the self-lock switch of FIG. 6 illustrating the self-lock switch in the process of transitioning to the safety configuration.
Figure 6B:
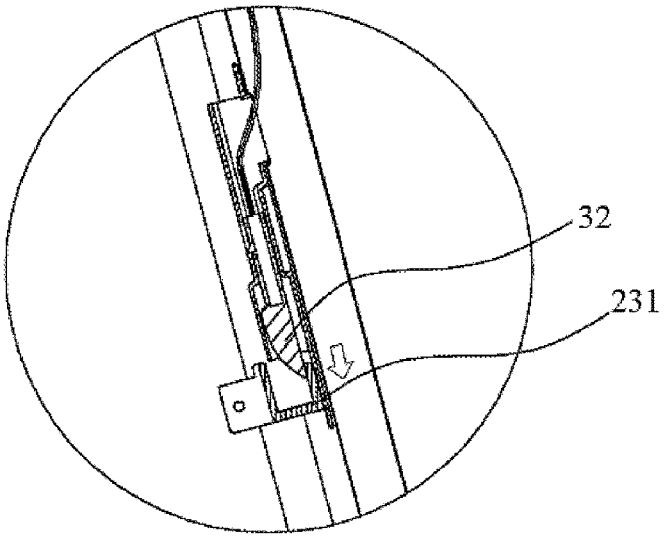
FIG. 6B is a detailed view of the self-lock switch of FIG. 6 illustrating the self-lock switch when the ladder assembly is in the safety configuration.

Furthermore, as bar 31 moves downwardly and protective door assembly 2 closes, snap joint 32 moves toward cassette 231. When snap joint 32 presses against cassette 231, snap joint 32 moves slightly upward along its curved outer surface 322 (as shown in FIG. 6A) until snap joint 32 drops into the cassette 231, under the force of gravity or a spring bias, to lock protective door assembly 2 into cassette 231 (as shown in FIG. 6B). This automatic locking prevents door panel assembly 2 from being unlocked and reopened until the user reengages bar 31.

Figure 7:
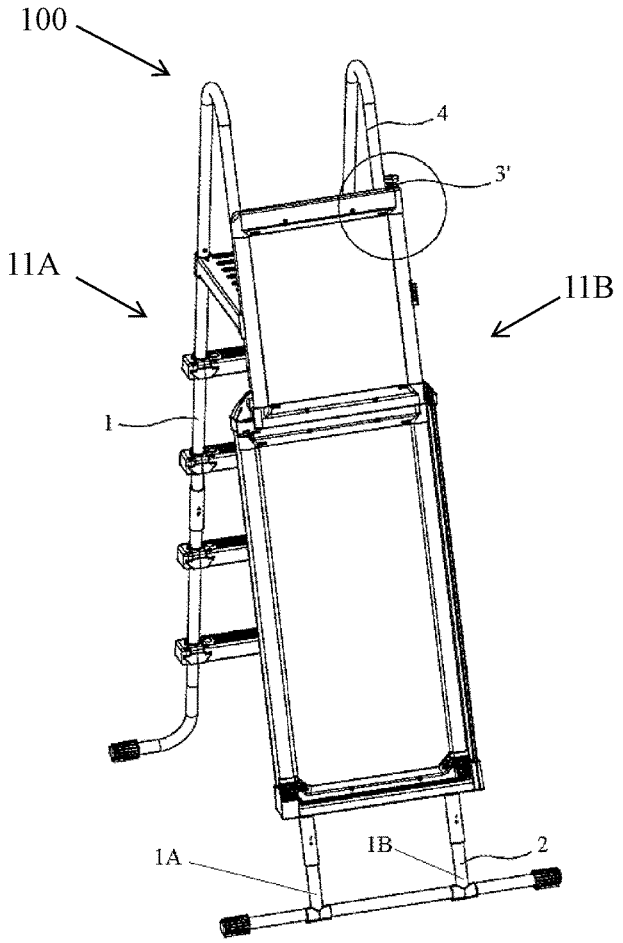
FIG. 7 is a perspective view of a second embodiment of a pool ladder assembly in accordance with the present disclosure.
Figure 7A:
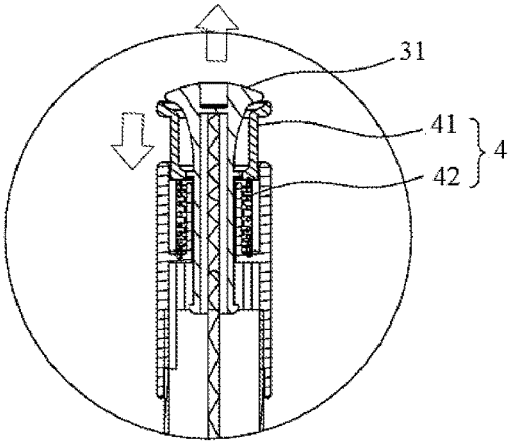
FIG. 7A is an enlarged cross sectional view of a self-lock switch of the pool ladder assembly of FIG. 7.

FIGS. 7 and 7A show another pool ladder 100 with an alternate lock switch 3'. The alternative lock switch 3' may have added security, especially when bar 31 of lock-switch 3' is positioned at a height lower than a threshold height from the ground. A protective covering 4 is provided on top of the top end of bar 31 such that the top end of bar 31 is inaccessible without removing protective covering 4 as described below. In one embodiment, the threshold height is 54 inches from the ground.

Protective covering 4 includes a protecting jacket 41 and a compression spring 42. Protecting jacket 41 covers bar 31 such that bar 31 is fully within protecting jacket 41 when pool ladder 100 is in the safety configuration. In operation, protecting jacket 41 moves in accordance with the movement of compression spring 42. In the default, safety configuration, protecting jacket 41 is urged upward under the action of the compression spring 42 to conceal bar 31 substantially or entirely, at least the gripping area of bar 31.

To move pool ladder 100 from the safety configuration to the ladder configuration, two actions are needed. First, protecting jacket 41 is moved downward against the compression spring 42 such that the upper part of bar 31 protrudes from the protecting jacket 41. Once exposed, bar 31 can be actuated (e.g. pulled/lifted upwards) to unlock protective door 2 after which, a user can push pivotable door panel 20 to open protective door 2.

Figure 8:
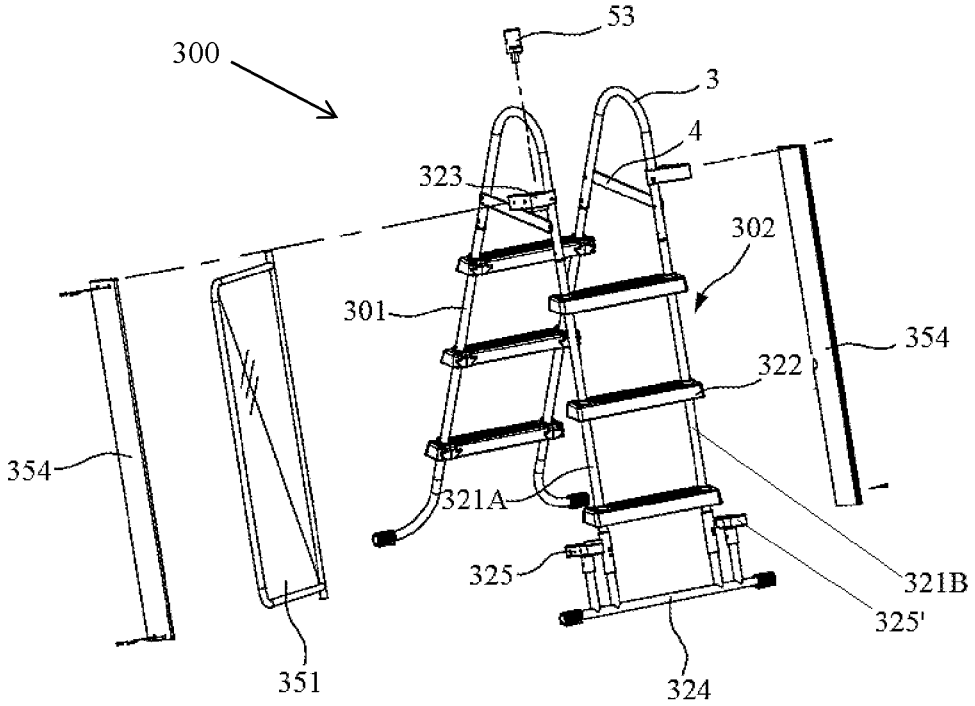
FIG. 8 is an exploded perspective view of a third embodiment of a pool ladder assembly in an accordance with the present disclosure.
Figure 9:
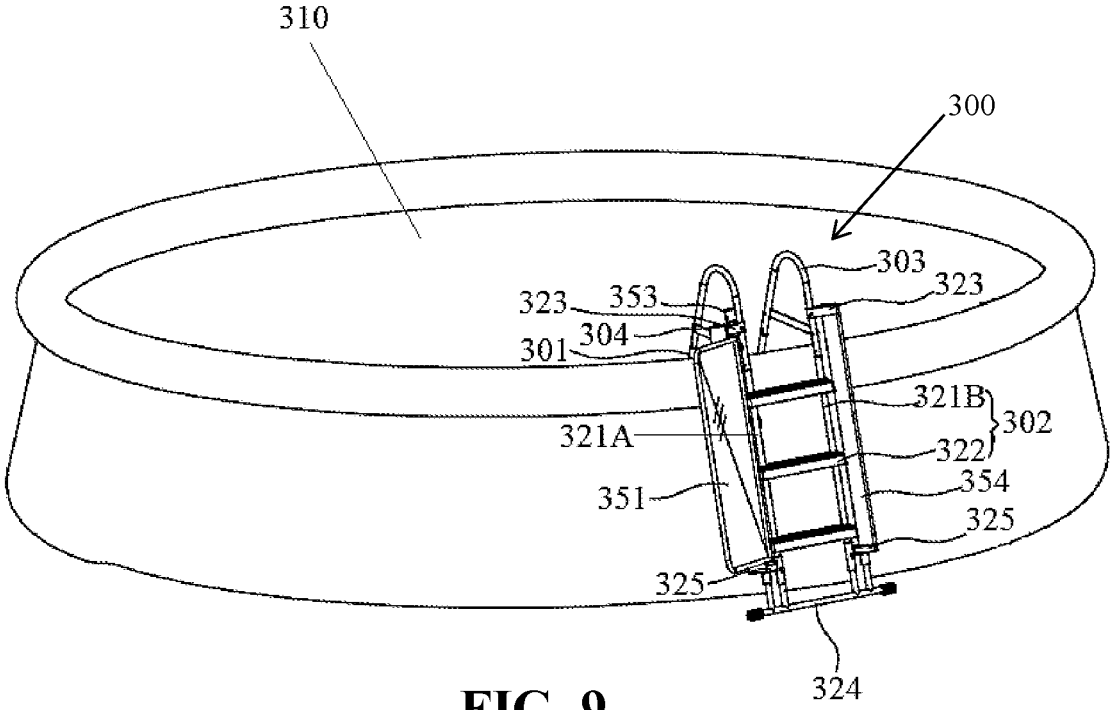
FIG. 9 is a perspective view of a water enclosure having the pool ladder assembly of FIG. 8, illustrated in a ladder configuration such that the water enclosure is accessible to a user.
Figure 10:
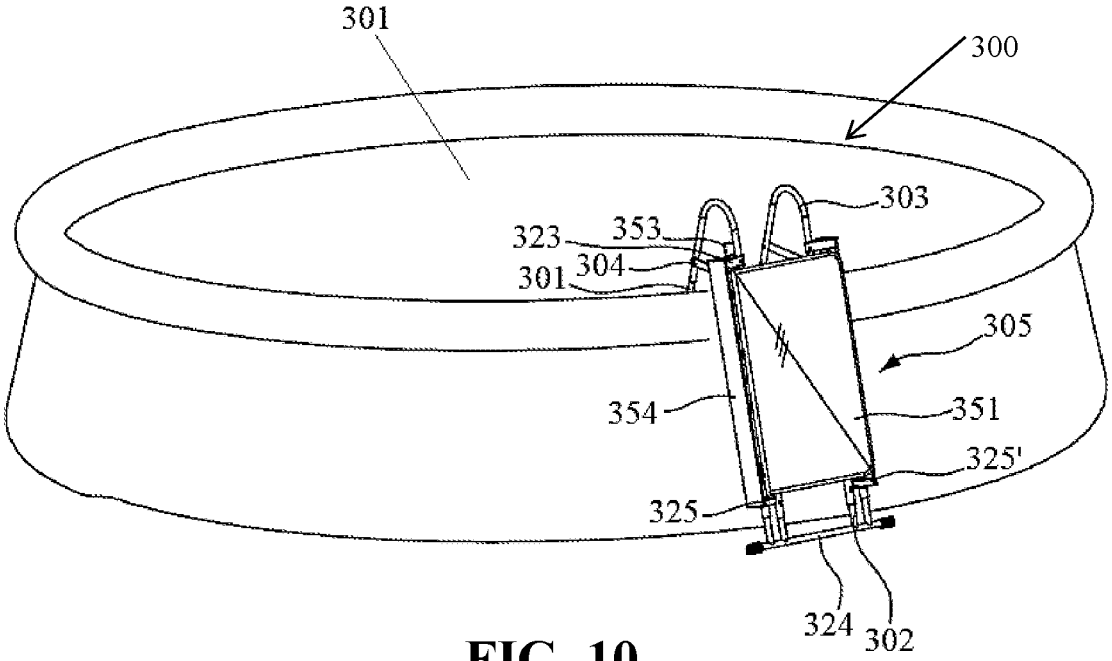
FIG. 10 is a perspective view of a water enclosure having the pool ladder assembly of FIG. 8, illustrated in a safety configuration such that the water enclosure is inaccessible to a user.

As shown in FIGS. 8-10, the present invention provides another pool ladder 300. Pool ladder 300 may be similar to the above-described pool ladders 10 and 100, except as described below. Pool ladder 300 includes an inside pool portion 301 configured for placement inside a water enclosure 310 (e.g., pool), an outside pool portion 302 configured for placement outside water enclosure 310, and a handrail 303 connecting the upper railings of the first and second portions 301, 302. A stable cross brace 304 is coupled to the upper railings of the first and second portions 301, 302 such that cross brace 304 connects the two portions so as to improve the strength and stability of ladder 300.

Figure 8A:
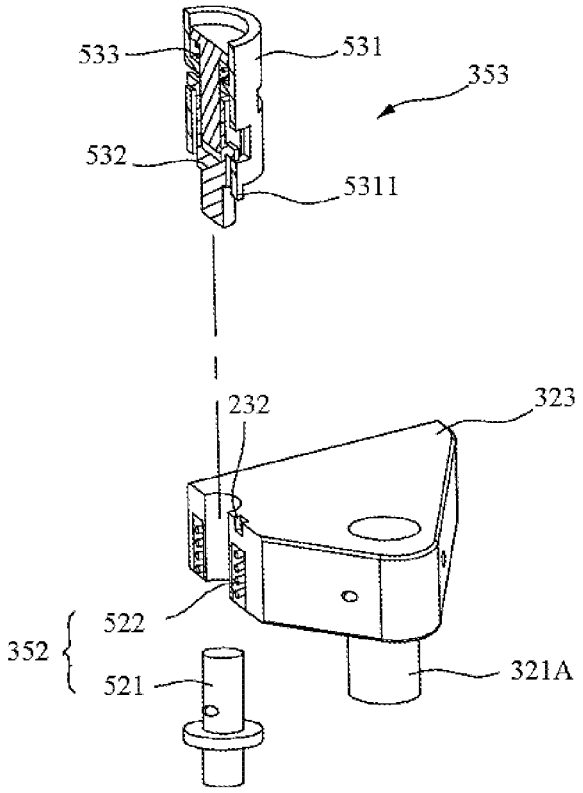
FIG. 8A is an exploded view of a lock device of the pool ladder assembly of FIG. 8.

Pool ladder 300 includes a protective door 305 (FIG. 10) coupled to outside pool portion 302, which blocks steps 322 of outside pool portion 302 when ladder 300 is in the safety configuration. Protective door 305 includes a mobile gate 351, an automatic reset mechanism 352, and a lock device 353, where automatic reset mechanism 352 and lock device 353 are both positioned on one side of mobile gate 351 as shown in FIGS. 8 and 8A. Further, lock device 353 is positioned on ladder 300 at a height (e.g., along the upper surface of mobile gate 351) such that it is not easily accessible for children.

Mobile gate 351 of the protective door 305 has a size that spans and covers a substantial area of outside pool portion 302 where steps 322 are covered in the safety configuration. Gate 351 is pivotally coupled to one of uprights 321, illustratively the left upright 321A, on outside pool portion 302. Pivoting of gate 351 occurs via a pivot seat 323 positioned along an upper end of upright 321A. The lower end of second portion 302 includes a lateral bar 324 resting on the ground and connecting uprights 321A and 321B together on outside pool portion 302. A pair of support bases 325, 325' is located at or near the bottom-most step 322 and is supported by the lateral bar 324. Support base 325 provides support for the lower end of mobile gate 351 and also provides a pivoting surface upon which gate 351 can pivot when transitioning between a ladder configuration and a safety configuration. Support base 325' provides support for the other end of gate 351 by providing an area upon which the other end of gate 351 can rest when gate 351 is in the safety configuration. In this manner, the lower end of mobile gate 351 may be located at or near the bottom-most step 322 and elevated above the ground.

Gate 351 further includes an automatic reset mechanism 352 positioned at pivot seat 323 on the side of gate 351 that pivots during operation. Automatic reset mechanism 352 includes a rotating damper 521 and a torsion spring 522 where the rotating damper 521 serves as the pivoting shaft of mobile gate 351.

Lock device 353 is coaxial with automatic reset mechanism 352 and coupled to pivot seat 323. Lock device 353 includes a lock sleeve 531, a support shaft 532 within lock sleeve 531, a spring 533 wrapped around support shaft 532, and a rotating shaft connected to the rotating damper 521. Lock sleeve 531 includes a lock catch 5311 that can movably fit into a lock groove 232 of pivot seat 323.

To prevent injury while rotating mobile gate 351, a protection cover 354 is provided along both edges of mobile gate 351 on uprights 321A, B of outside pool portion 302 as shown in at least FIG. 8. In an alternate embodiment, protection cover 354 is provided only at the pivot side of mobile gate 351.

As shown in FIG. 10, when protective door 305 is assembled, mobile gate 351 is in a safety configuration and locked by default. To open mobile gate 351, lock sleeve 531 of lock device 353 is actuated by pulling lock sleeve 531 upward against the force of lock spring 533 such that lock catch 5311 disengages with and moves away from lock groove 232 of pivot seat 323 thereby unlocking mobile gate 351. Mobile gate 351 can then be opened by applying an outward force onto mobile gate 351 such that gate 351 rotates outwardly from outside pool portion 302 about pivot seat 323. When mobile gate 351 is fully opened, pool ladder 300 is in the ladder configuration and steps 322 of outside pool portion 302 are accessible to users, as shown in FIG. 9.

When a force is no longer applied onto mobile gate 351, mobile gate 351 will return to the safety configuration by a biasing force applied by torsion spring 522. Damper 521 reduces the amount of biasing force applied onto mobile gate 351 by absorbing a portion of the biasing force of torsion spring 522. In this way, the speed at which mobile gate 351 closes is reduced thereby preventing sudden transitions from the ladder configuration to the safety configuration. Once mobile gate returns to the safety configuration, lock catch 5311 of the lock sleeve 531 engages and fits within lock groove 232 under the biasing force of lock spring 533 such that mobile gate 351 is locked and steps 322 are not easily accessible, as shown in FIG. 10.

When exiting water enclosure 310, lock device 353 needs to be actuated as described above to unlock mobile gate 351. Then, gate 351 can be rotated as described above to access steps 322 and allow successful egress from water enclosure 310. Upon release of mobile gate 351, automatic reset mechanism 352 will return mobile gate 351 to its safety configuration where mobile gate 351 will lock into place.

Figure 11:
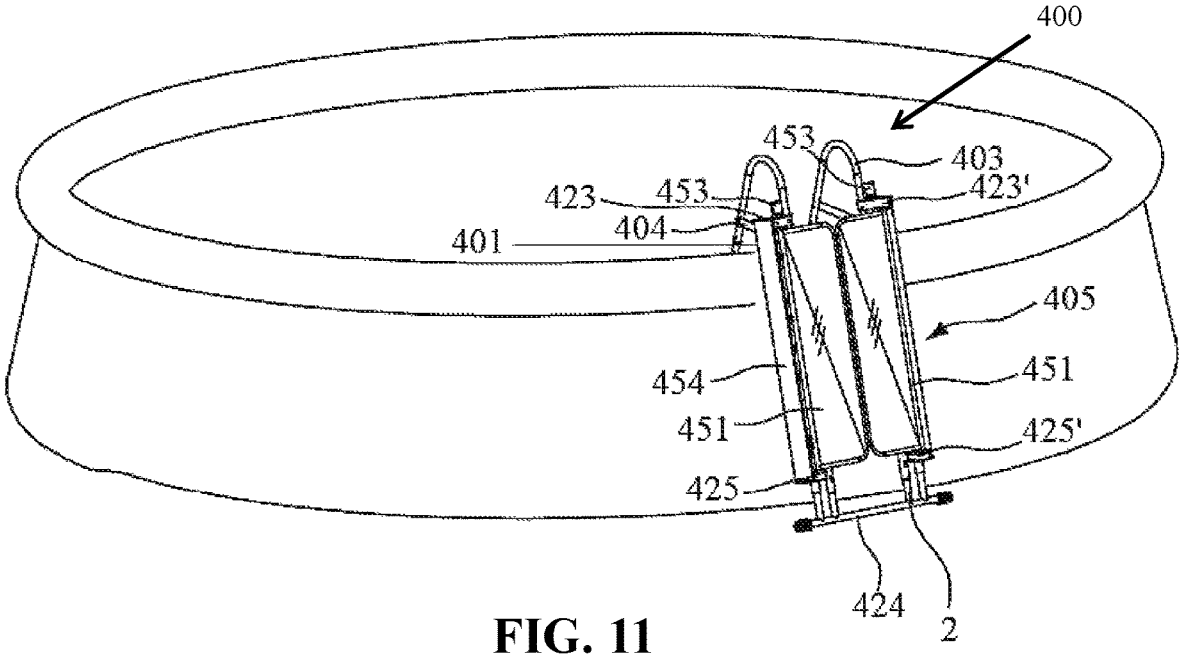
FIG. 11 is a perspective view of a water enclosure with a fourth embodiment of a pool ladder assembly in accordance with the present disclosure, illustrated in a safety configuration such that the water enclosure is inaccessible to a user.

Referring now to FIG. 11, another pool ladder 400 is shown. Pool ladder 400 is otherwise substantially similar to pool ladder 300 described herein, with reference numerals of ladder 400 analogous to the reference numerals of ladder 300, except with 400 added thereto. Pool ladder 400 includes an alternate mobile gate of safety door 405 where the mobile gate includes two mobile gates 451, 451' that are each pivotable about respective pivot seats 423, 423' and support bases 425, 425' that are each located adjacent to the outer edges of mobile gates 451, 451'. The pivot seats 423. 423' and/or each support base 425, 425' of uprights 421A, 421B are each disposed with automatic reset mechanism 352. Furthermore, lock devices 453, 453' are positioned on pivots seat 423, 423' of uprights 421A, B.

In one embodiment, protective doors 2, 305, 405, and 405', of ladders 10, 300 and 400 are removably coupled to the ladders. As such, protective doors 2, 305, 405, and 405' can be dismounted from ladders 10, 300, 400, which is convenient for storage purposes. Furthermore, protective doors 2, 305, 405, and 405' can be modular such that a user can purchase any one protective doors 2, 305, 405, 405' to install onto a pool ladder. In an alternate embodiment, protective doors 2, 305, 405, 405' can be integrally formed with ladders 10, 300,400.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A safety ladder configured for use with a water enclosure, the safety ladder comprising:

a pair of uprights defining a gap therebetween with at least one step spanning the gap, the safety ladder having an inside pool portion configured to be positioned within the water enclosure and an outside pool portion configured to be positioned outside the water enclosure, the outside pool portion including:

a protective door coupled to the pair of uprights, wherein the protective door includes an upper frame and a lower frame coupled to the upper frame, wherein, when measured in a direction spanning the gap, the upper frame is narrower than the lower frame;

a support base coupled to each upright, the protective door rotating relative to the support base between a ladder configuration when the protective door is opened and the at least one step is accessible and a safety configuration when the protective door is closed and the protective door covers the at least one step.

2. The safety ladder of claim 1, further including a lock switch positioned along an upper surface of the upper frame of the protective door.

3. The safety ladder of claim 2, wherein the lock switch further includes a movable bar that protrudes from the upper surface of the upper frame and a snap joint that selectively engages with a cassette.

4. The safety ladder of claim 3, wherein when the lock switch is moved upwardly away from the upper surface of the upper frame, the moveable bar moves upwardly and snap joint disengages from the cassette and unlocks the protective door to move to the ladder configuration; and wherein when the lock switch is released from the upward position, the protective door moves towards the safety configuration and the moveable bar moves downwardly, wherein the snap joint presses against the cassette and engages with the cassette to lock the protective door in the safety configuration.

5. The safety ladder of claim 4, wherein the movement of the moveable bar when the lock switch is released is encouraged by a spring operably coupled to the moveable bar.

6. The safety ladder of claim 1, wherein the support base forms a bottom-most step of the safety ladder.

7. The safety ladder of claim 1, further including:

a spring coupled to the protective door, the spring applying a biasing force onto the protective door to bias the protective door to the safety configuration; and a damper coupled to the protective door acting to delay closure by opposing the biasing force acting on the protective door.

8. The safety ladder of claim 1, further including a lock switch positioned along an upper surface of the upper frame of the protective door.

9. The safety ladder of claim 8, wherein the lock switch further includes a movable bar that protrudes from the upper surface of the upper frame and a snap joint that selectively engages with a cassette.

10. The safety ladder of claim 9, wherein:

when the lock switch is moved upwardly away from the upper surface of the upper frame, the moveable bar moves upwardly and the snap joint disengages from the cassette and unlocks the protective door to move to the ladder configuration; and when the lock switch is released, the moveable bar moves downwardly and the snap joint presses engages with the cassette to lock the protective door in the safety configuration.

11. The safety ladder of claim 10, wherein downward movement of the moveable bar when the lock switch is released is encouraged by a spring operably coupled to the moveable bar.

12. A safety ladder configured for use with a water enclosure, the safety ladder having an inside pool portion configured to be positioned within the water enclosure and an outside pool portion configured to be positioned outside the water enclosure, the outside pool portion comprising:

a left upright;

a right upright spaced apart from the left upright to define a gap therebetween;

at least one step spanning the gap and coupled to the left and right uprights;

a support base spanning the gap and coupled to the left and right uprights;

a protective door including an upper frame and a lower frame, the protective door configured to rotate atop the support base between a ladder configuration when the protective door is opened and the at least one step is accessible and a safety configuration when the protective door is closed and the protective door covers the at least one step;

a left pillar coupled to the support base and extending between the left upright and the protective door across a height of the lower frame of the protective door, the left pillar having a bottom end inserted in the support base; and a right pillar coupled to the support base and extending between the right upright and the protective door across the height of the lower frame of the protective door, the right pillar having a bottom end inserted in the support base.

13. The safety ladder of claim 12, wherein the support base is elevated above a ground and serves as a bottom-most step of the safety ladder.

14. The safety ladder of claim 12, further comprising:

a left cover coupled to a top end of the left pillar;

a right cover coupled to a top end of the right pillar; and a door closing mechanism coupled to one of the left and right covers and configured to move the door from the ladder configuration to the safety configuration.

15. The safety ladder of claim 14, wherein the door closing mechanism includes:

a spring coupled to the protective door, the spring applying a biasing force onto the protective door to bias the protective door to the safety configuration; and a damper coupled to the protective door acting to delay closure by opposing the biasing force acting on the protective door.

16. The safety ladder of claim 12, further including a lock switch positioned along an upper surface of the upper frame of the protective door.

17. The safety ladder of claim 16, wherein the lock switch further includes a movable bar that protrudes from the upper surface of the upper frame and a snap joint that selectively engages with a cassette.

18. The safety ladder of claim 17, wherein:

when the lock switch is moved upwardly away from the upper surface of the upper frame, the moveable bar moves upwardly and the snap joint disengages from the cassette and unlocks the protective door to move to the ladder configuration; and when the lock switch is released, the moveable bar moves downwardly and the snap joint presses engages with the cassette to lock the protective door in the safety configuration.

19. The safety ladder of claim 18, wherein downward movement of the moveable bar when the lock switch is released is encouraged by a spring operably coupled to the moveable bar.

* * * * *